US008460233B2

(12) United States Patent
McCoy

(10) Patent No.: US 8,460,233 B2
(45) Date of Patent: Jun. 11, 2013

(54) BREASTFEEDING SHIELD

(76) Inventor: LaTina D. McCoy, Upper Marlboro, MD (US)

( * ) Notice: Subject to any disclaimer, the term of this patent is extended or adjusted under 35 U.S.C. 154(b) by 0 days.

(21) Appl. No.: 13/330,594

(22) Filed: Dec. 19, 2011

(65) Prior Publication Data

US 2012/0165730 A1 Jun. 28, 2012

Related U.S. Application Data

(60) Provisional application No. 61/426,414, filed on Dec. 22, 2010.

(51) Int. Cl.
*A61H 11/00* (2006.01)

(52) U.S. Cl.
USPC ..... 604/74

(58) Field of Classification Search
USPC ..... 604/74; 606/236; 417/36
See application file for complete search history.

(56) References Cited

U.S. PATENT DOCUMENTS

| | | | | |
|---|---|---|---|---|
| 78,881 | A | 6/1868 | Libbey | |
| 296,609 | A | 4/1884 | Pattee | |
| D381,752 | S * | 7/1997 | McCoy | D24/196 |
| D404,825 | S * | 1/1999 | Reed | D24/198 |
| 6,669,064 | B2 * | 12/2003 | Perricone | 224/148.6 |
| 6,821,185 | B1 | 11/2004 | Francis | |
| 7,335,183 | B2 * | 2/2008 | Buiatti | 604/76 |
| D576,283 | S * | 9/2008 | Marshall et al. | D24/198 |
| D584,399 | S * | 1/2009 | Pacini | D24/109 |
| D652,146 | S * | 1/2012 | Francis | D24/196 |
| 8,172,874 | B2 * | 5/2012 | Randolph et al. | 606/236 |
| 8,357,117 | B2 * | 1/2013 | Sokal et al. | 604/76 |
| 2008/0039781 | A1 | 2/2008 | Bjorge | |
| 2008/0146118 | A1 | 6/2008 | Solberg et al. | |
| 2008/0287037 | A1 * | 11/2008 | Solberg | 450/36 |
| 2009/0149114 | A1 * | 6/2009 | Horton et al. | 450/54 |
| 2009/0166481 | A1 | 7/2009 | Chen | |
| 2009/0194116 | A1 * | 8/2009 | Pacini | 128/890 |
| 2010/0292637 | A1 * | 11/2010 | Sokal et al. | 604/76 |
| 2012/0165730 | A1 * | 6/2012 | McCoy | 604/76 |

FOREIGN PATENT DOCUMENTS

| | | |
|---|---|---|
| CN | 2907276 | 6/2007 |

* cited by examiner

*Primary Examiner* — Nicholas Lucchesi
*Assistant Examiner* — Diva K Chander
(74) *Attorney, Agent, or Firm* — Richard C. Litman

(57) ABSTRACT

The breastfeeding shield is configured for comfort and to facilitate the breastfeeding of an infant. The shield is formed of a soft thermoplastic elastomeric, e.g., silicone rubber or the like, and has a major portion closely conforming to the major contours of the female human breast. The major portion is relatively thin, the portion covering the areola being relatively thick and the nipple portion having an intermediate thickness. The hollow nipple includes reinforcing and spacing ribs therein to preclude contact with the natural nipple due to suction and resulting blockage of milk flow. One embodiment is configured for use by full term infants, and another embodiment has a smaller nipple extension for use by premature infants. Different sizes may be provided to suit the nursing mother. The shield is removably secured to the breast by disposable or reusable low-stick adhesive materials.

18 Claims, 4 Drawing Sheets

BREASTFEEDING SHIELD

CROSS-REFERENCE TO RELATED APPLICATION

This application claims the benefit of U.S. Provisional Patent Application Ser. No. 61/426,414, filed Dec. 22, 2010.

BACKGROUND OF THE INVENTION

1. Field of the Invention

The present invention relates generally to the practice of nursing an infant, and particularly to various embodiments of a breastfeeding shield for protecting the breast of the nursing mother and/or assisting the nursing infant.

2. Description of the Related Art

While evolution has resulted in natural breastfeeding for all mammals, this natural function is by no means perfect. In the case of humans, many nursing mothers experience difficulty in nursing their infants due to chapping, cracking, inflammation (mastitis), and/or various other breast problems that may occur in nursing. In many instances this can lead to difficulty in providing sufficient nutrition for the nursing infant, particularly in less developed parts of the world where access to infant formulas and medical treatment is not readily available. Where infant sustenance is marginal, this may result in various nutrition-related illnesses in the infant, and may even possibly be a factor in the higher infant mortality rates in such areas of the world. Breast damage due to nursing may also lead to breast infection, which, in the case of nursing mothers unable to get proper medical treatment, may result in serious illness for the mother and of course further problems in nursing the infant.

Various solutions have been developed for the above problems. One such solution is the infant formula, allowing an infant to bottle feed and still receive proper nutrition. A more direct solution to breastfeeding problems experienced by many mothers was the development of the breastfeeding shield. However, in the past many, if not most, such shields were less than satisfactory due to the materials from which they were made (natural rubber, in many earlier shields), shape (many earlier shields would not conform well to the breast, thus limiting milk flow or allowing leakage), nipple configuration (limiting the ability of the infant to draw milk through the device), sanitation (difficulty in cleaning), and perhaps other problems. While improvements have been made more recently, the conventional breastfeeding shield still does not facilitate milk flow and provide a natural fit for the infant's mouth, particularly in the case of premature infants.

An example of such an earlier breastfeeding shield is found in Chinese Patent Publication No. CN2907276, published on Jun. 6, 2007. This publication describes (according to the drawings and English abstract) a brassiere for nursing mothers, comprising a pair of breastfeeding shields connected by a bra strap.

Thus, a breastfeeding shield solving the aforementioned problems is desired.

SUMMARY OF THE INVENTION

The breastfeeding shield includes various embodiments for use by infants at varying stages of development. A first embodiment comprises a shield conforming to a major portion of the breast curvature surrounding the nipple, and covers that portion of the breast including the areola and nipple. The nipple portion of the shield includes milk flow passages therethrough and a plurality of reinforcing or spacing ribs within the hollow nipple separating the milk flow passages from one another and from direct contact with the nipple to facilitate milk flow, but reducing or precluding suction that might otherwise seal the device to the nipple of the breast and produce irritation of the mother's nipple. The shield is formed of a very soft thermoplastic elastomeric compound, e.g., a silicone rubber material or the like. The thickness of the material varies at different areas of the shield, the larger portion having a relatively thin wall, the areola portion having a relatively thick wall, and the nipple having a wall thickness between that of the major area and the areola.

A second embodiment is configured for use by premature infants and has a smaller nipple portion extending from the major nipple, which in turn extends from the areola. The material and remainder of the configuration of the second embodiment shield are essentially the same as those properties of the first embodiment shield.

Both shields are removably secured to the breast of the nursing mother by adhesive means. The adhesive is a relatively low stick material for ease of removal, e.g., on the order of electrostatic attraction or the single surface adhesive of temporary office notes and the like. The adhesive attachments may be provided directly on the contact surface of the shield, or may alternatively be provided in the form of permanently attached or removable tabs extending from the periphery of the shield.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The breastfeeding shield comprises two different embodiments. A first embodiment provides for the breastfeeding of full term delivery infants, and a second embodiment provides for the breastfeeding of premature infants. Both embodiments provide various improvements in the art.

Figure 1:
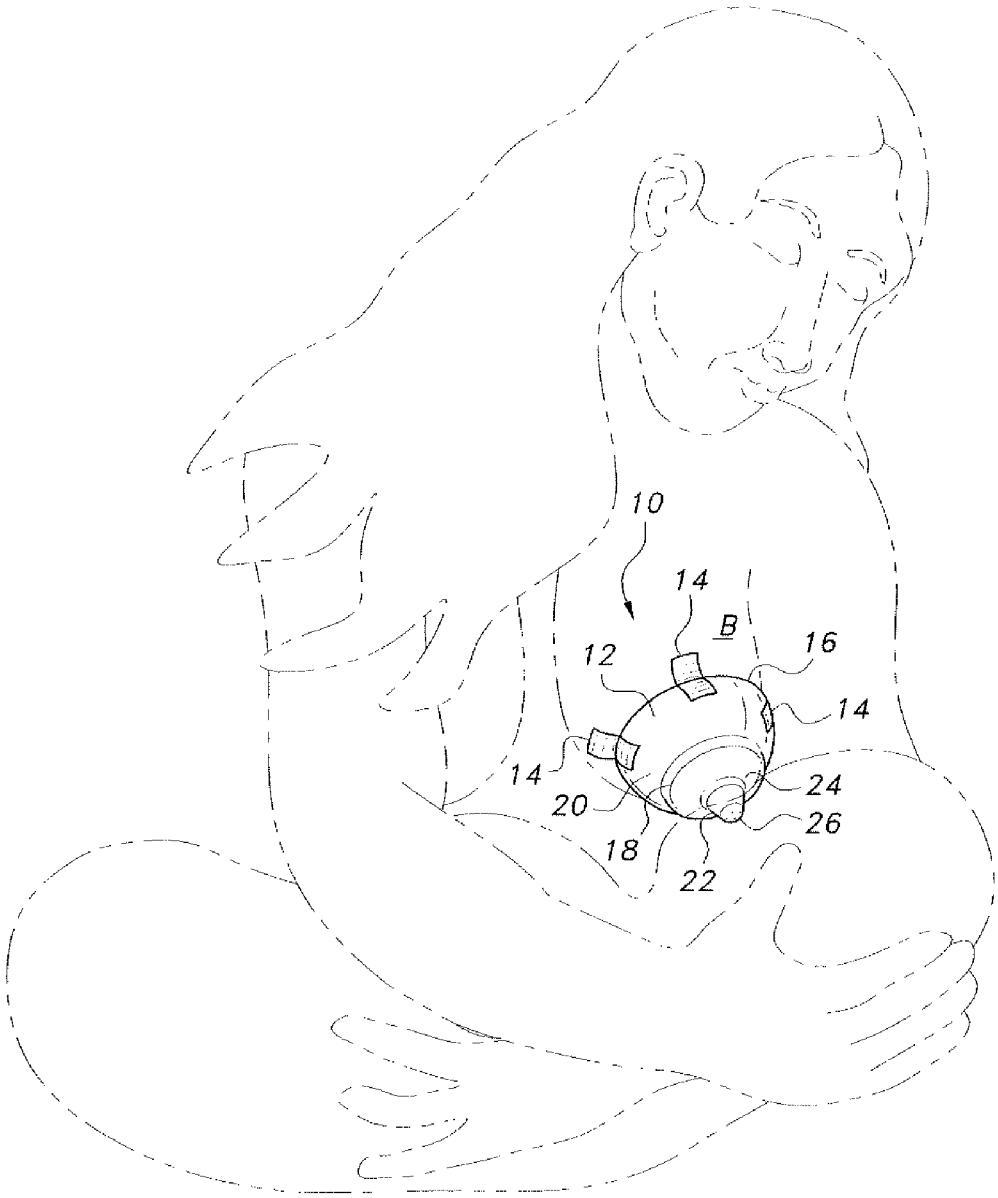
FIG. 1 is an environmental, perspective view of a breastfeeding shield according to the present invention.
Figure 2:
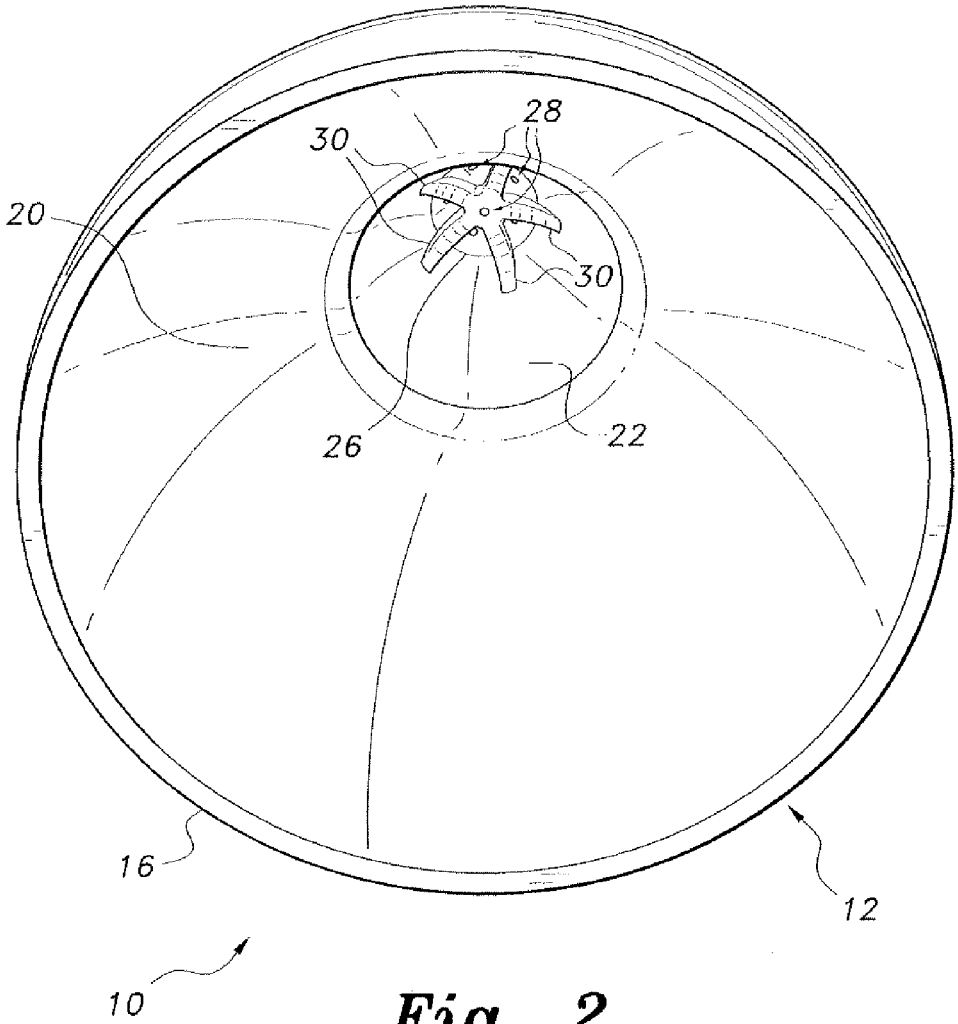
FIG. 2 is a perspective view of the breastfeeding shield of FIG. 1 as seen from the rear of the shield, showing internal details thereof.
Figure 3:
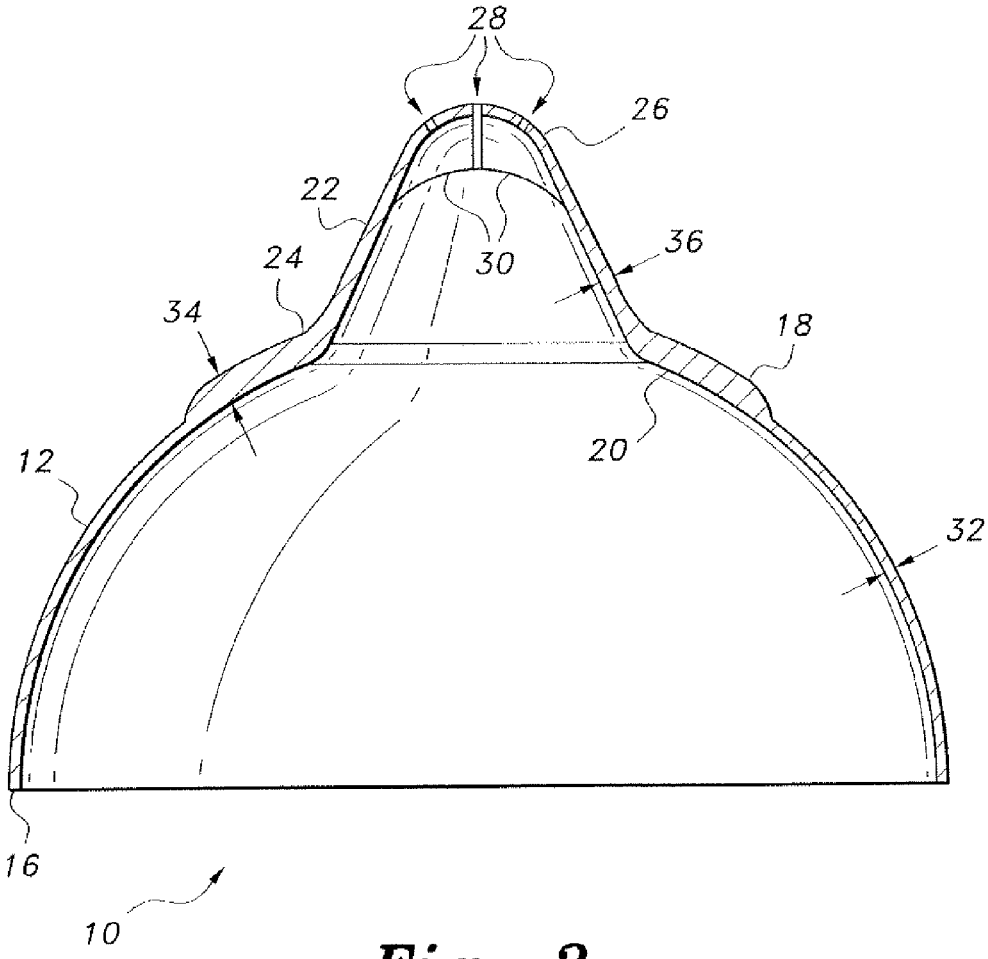
FIG. 3 is a side view in section of the breastfeeding shield of FIGS. 1 and 2, showing further details thereof.

FIGS. 1 through 3 illustrate a first embodiment of the breastfeeding shield, designated as breastfeeding shield or shield 10. The shield 10 is formed of a soft, pliable elastomeric material, such as silicone rubber or the like. The material is preferably transparent, although colors or dyes may be added to make the shield 10 translucent or opaque. The shield 10 is molded or otherwise formed to conform closely to the contours of the human female breast. As human female breasts vary widely in size and other physical characteristics, the breastfeeding shield 10 may be manufactured in a wide range of sizes.

The breastfeeding shield 10 has a hollow, generally hemispherical breast cup portion 12 configured to fit and conform closely to a major area of the breast, generally as shown in the environmental view of FIG. 1. A plurality of adhesive tabs 14 extends from the periphery 16 of the cup portion 12 for securing the shield 10 temporarily to the breast B of the nursing mother. The adhesive tabs 14 are provided with a low-stick adhesive material in order to avoid undue stress to the relatively tender skin of the breast when removing the shield 10 from the breast B. An adhesive having a strength on the order of that provided on temporary office notes and the like is suitable. Alternatively, the tabs 14 may be formed of a thin plastic material with electrostatic attractive properties ("static cling") to provide the required adhesion. The tabs 14 may be formed as permanent, integral components of the breastfeeding shield 10, or they may be supplied with the shield 10 as separate, disposable items.

An areola area 18 is located in the central area 20 of the breast cup, the areola area 18 of the shield 10 corresponding with and conforming to the areola area of the natural breast. A hollow nipple 22 extends outwardly from the central area 24 of the areola 18. The nipple 22 has a rounded apex 26 having a plurality of milk flow passages 28 extending therethrough, as shown in FIGS. 2 and 3 of the drawings. FIGS. 2 and 3 also clearly show the radially disposed spacing and reinforcing ribs 30 located within the apex 26 of the nipple 22. These ribs 30 are spaced between and alternate with the milk flow passages 28 in the nipple apex 26 and serve to provide an air gap or space between the inner surface of the nipple 22, and particularly the inner surface of its apex 26, and the underlying surface or skin of the breast nipple of the nursing mother when the breast shield 10 is being used. The suction produced by the nursing infant will often draw the flesh of the breast nipple up tightly within the nipple of the conventional shield, which may result in undue irritation of the breast nipple, particularly when the nursing session has been completed and the nursing mother removes the conventional breastfeeding shield. The spacing and reinforcing ribs 30 serve to break this suction, thereby providing more comfort for the nursing mother using the breastfeeding shield 10, particularly when it is removed. The ribs 30 also provide some reinforcement for the soft material of which the nipple 22 is made and provide greater resistance to damage from the nursing infant, particularly as some infants may continue to nurse naturally even as they begin teething.

The breastfeeding shield 10 is configured with various relative thickness of material at various areas thereof, as shown in the elevation view in section of FIG. 3. It will be understood that the actual material thickness is exaggerated in FIG. 3 for clarity in the drawing. The breast cup 12 portion is relatively thin, having a wall thickness 32 of about 0.015 inch (fifteen thousandths of an inch). However, the areola area 18 is approximately twice as thick as the breast cup 12, having a wall thickness 34 of about 0.030 inch (thirty thousandths of an inch). The wall thickness 36 of the nipple 22 is intermediate the breast cup wall thickness 32 and the areola wall thickness 34, having a wall thickness on the order of 0.020 inch (twenty thousandths of an inch). These thicknesses are exemplary, and may be varied as required to optimize the breastfeeding shield 10 for different sizes or for other purposes.

Figure 4:
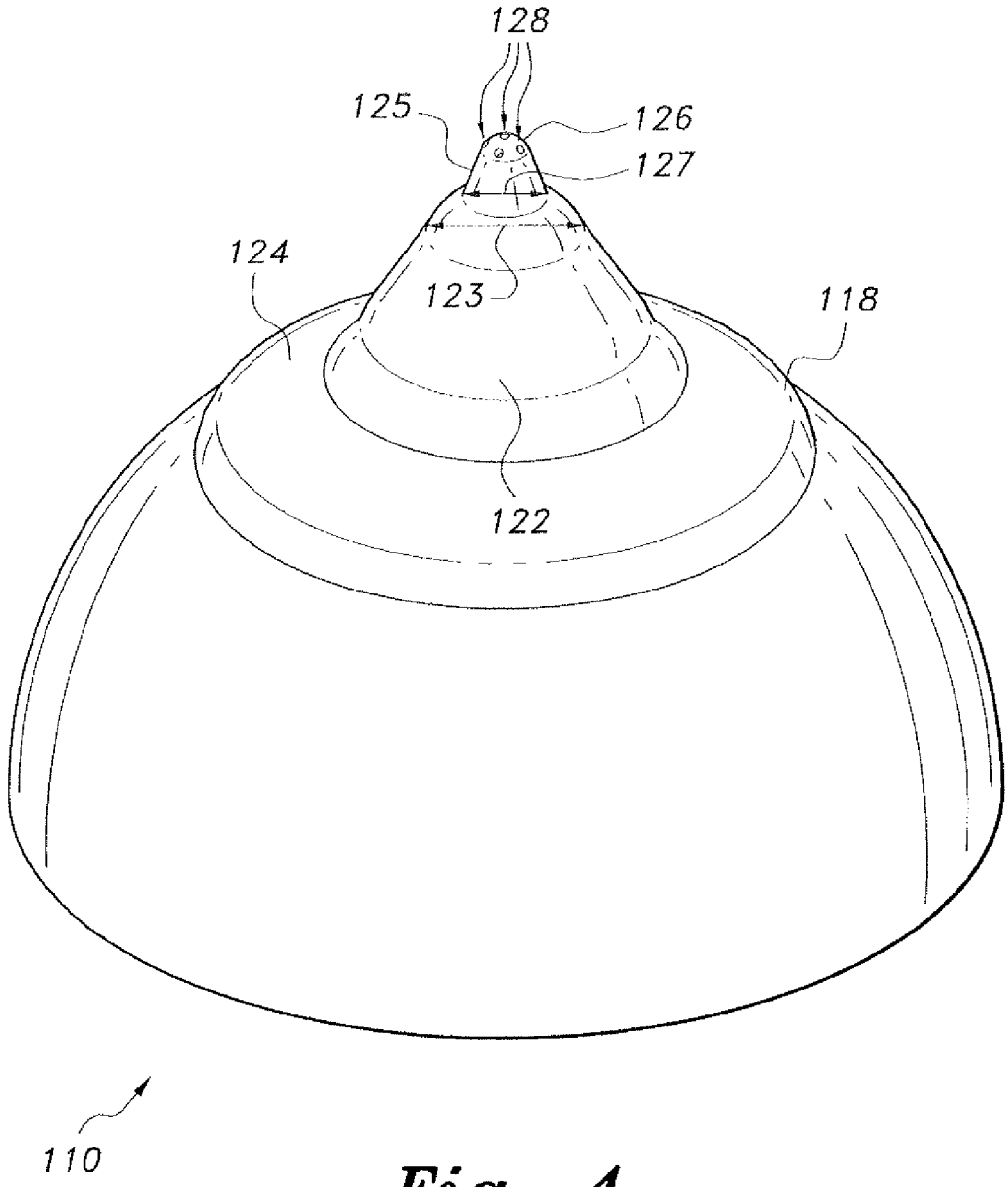
FIG. 4 is a perspective view of an alternative embodiment of a breastfeeding shield according to the present invention adapted for use in feeding premature infants.

FIG. 4 of the drawings provides a perspective view of an alternative embodiment of the breastfeeding shield, designated as breastfeeding shield or shield 110. The breastfeeding shield 110 is substantially the same as the breastfeeding shield 10, with the exception of the nipple structure. The nipple structure of the shield 110 is configured particularly for premature infants, who have smaller mouths and lower strength than full term infants. The nipple structure of the shield 110 comprises a generally conical, hollow nipple base 122 extending from the central area 124 of the areola 118, the upper portion of the nipple base 122 having a minor diameter 123. A smaller, hollow nipple extension 125 extends from the nipple base 122. The nipple extension 125 has a major diameter 127 that is somewhat smaller than the minor diameter 123 of the nipple base 122. This provides a nipple extension size that is sufficiently small for use by a premature infant. The nipple extension 125 is configured generally like the standard size nipple 22 of the breastfeeding shield 10 embodiment of FIGS. 1 through 3 but to a smaller scale, the nipple extension 125 having a rounded apex 126 with a plurality of milk flow passages 128 extending therethrough. The interior of the nipple extension 125 may be provided with a series of internal spacing and reinforcement ribs, substantially like the construction shown in FIGS. 2 and 3 for the larger scale nipple 22.

The breastfeeding shield 10 or 110 in its various embodiments will be seen to provide a much improved means of protecting the breast(s) of a nursing mother and facilitating the nursing of an infant as well. The device is relatively economical to manufacture due to its preferably molded configuration and material, which allow the breast cup, areola, and nipple or nipple base and extension to be formed as a unitary component. The breastfeeding shields 10 and 110 are also easily cleaned, enabling them to be sanitized for reuse as needed. Accordingly, the breastfeeding shield in its various embodiments provides a greatly needed improvement in such devices for the nursing mother and infant.

It is to be understood that the present invention is not limited to the embodiments described above, but encompasses any and all embodiments within the scope of the following claims.

I claim:

1. A breastfeeding shield, comprising:

a hollow, generally hemispherical breast cup having a central area and a periphery, the breast cup is formed of a thin material having a wall thickness;

an areola area disposed in the central area of the breast cup, the areola area having a center, the areola area has a wall thickness greater than the wall thickness of the breast cup;

a hollow nipple extending from the center of the areola area, the nipple having a rounded apex and a plurality of milk flow passages disposed through the apex of the nipple, the nipple has a wall thickness between the wall thickness of the breast cup and the wall thickness of the areola area; and a plurality of reinforcing and spacing ribs disposed within the nipple, between the milk flow passages.

2. The breastfeeding shield according to claim 1, wherein the nipple comprises:

a generally conical, hollow nipple base extending from the center of the areola area, the nipple base having a minor diameter; and a hollow nipple extension extending from the nipple base, the nipple extension having a major diameter smaller than the minor diameter of the nipple base, the nipple extension having an apex, the plurality of milk flow passages being disposed through the apex.

3. The breastfeeding shield according to claim 1, further including adhesive tabs disposed about the periphery of the breast cup.

4. The breastfeeding shield according to claim 3, wherein the adhesive tabs are disposable.

5. The breastfeeding shield according to claim 3, wherein the adhesive tabs are permanently attached to the periphery of the breast cup and extend therefrom.

6. The breastfeeding shield according to claim 1, wherein the breast cup, the areola area, and the nipple are formed as a single, unitary component of soft, flexible, substantially transparent silicone elastomer material.

7. A breastfeeding shield, comprising:

a thin, hollow, generally hemispherical breast cup having a central area, a periphery, and a wall thickness;

an areola area disposed in the central area of the breast cup, the areola area having a center and a wall thickness greater than the wall thickness of the breast cup; and a hollow nipple extending from the center of the areola area, the nipple having a rounded apex and a wall thickness between the wall thickness of the breast cup and the wall thickness of the areola area, the nipple having a plurality of milk flow passages disposed through the apex of the nipple.

8. The breastfeeding shield according to claim 7, wherein the nipple comprises:

a generally conical, hollow nipple base extending from the center of the areola area, the nipple base having a minor diameter; and a hollow nipple extension extending from the nipple base, the nipple extension having a major diameter smaller than the minor diameter of the nipple base, the nipple extension having an apex, the plurality of milk flow passages being disposed through the apex.

9. The breastfeeding shield according to claim 7, further including adhesive tabs disposed about the periphery of the breast cup.

10. The breastfeeding shield according to claim 9, wherein the adhesive tabs are disposable.

11. The breastfeeding shield according to claim 9, wherein the adhesive tabs are permanently attached to the periphery of the breast cup and extend therefrom.

12. The breastfeeding shield according to claim 7, wherein the breast cup, the areola area, and the nipple are formed as a single, unitary component of soft, flexible, substantially transparent silicone elastomer material.

13. A breastfeeding shield, comprising:

a hollow, generally hemispherical breast cup having a central area and a periphery;

an areola area disposed in the central area of the breast cup, the areola area having a center;

a generally conical, hollow nipple base extending from the center of the areola area, the nipple base having a minor diameter; and a hollow nipple extension extending from the nipple base, the nipple extension having a major diameter smaller than the minor diameter of the nipple base, the nipple extension further having an apex and a plurality of milk flow passages disposed therethrough.

14. The breastfeeding shield according to claim 13, further including a plurality of reinforcing and spacing ribs disposed within the nipple extension, between the milk flow passages.

15. The breastfeeding shield according to claim 13, wherein:

the breast cup is formed of a thin material having a wall thickness;

the areola area has a wall thickness greater than the wall thickness of the breast cup; and the nipple base and the nipple extension each have a wall thickness between the wall thickness of the breast cup and the wall thickness of the areola area.

16. The breastfeeding shield according to claim 13, further including adhesive tabs disposed about the periphery of the breast cup.

17. The breastfeeding shield according to claim 16, wherein the adhesive tabs are selected from the group consisting of a plurality of disposable adhesive tabs and a plurality of adhesive tabs permanently attached to the periphery of the breast cup and extending therefrom.

18. The breastfeeding shield according to claim 13, wherein the breast cup, the areola area, the nipple base, and the nipple extension are formed as a single, unitary component of soft, flexible, substantially transparent silicone elastomer material.

* * * * *